US005104303A

United States Patent [19]

Mori et al.

[11] Patent Number: 5,104,303

[45] Date of Patent: Apr. 14, 1992

[54] INTERNAL GEAR PUMP WITH TAPERED OIL POCKETS IN SLIDING SURFACES

[75] Inventors: Sanae Mori; Kosaburo Niwa, both of Nagoya, Japan

[73] Assignee: Daido Metal Company Ltd., Tokyo, Japan

[21] Appl. No.: 552,653

[22] Filed: Jul. 16, 1990

Related U.S. Application Data

[63] Continuation-in-part of Ser. No. 233,544, Aug. 18, 1988, abandoned.

[30] Foreign Application Priority Data

Aug. 31, 1987 [JP] Japan ..... 62-131609[U]
May 25, 1988 [JP] Japan ..... 63-125866

[51] Int. Cl.[5] ..... F04C 2/10; F04C 15/00

[52] U.S. Cl. ..... 418/75; 418/80; 418/102; 418/170

[58] Field of Search ..... 418/75, 79, 80, 102, 418/170

[56] References Cited

FOREIGN PATENT DOCUMENTS 53-126504 11/1978 Japan ..... 418/75
54-152209 11/1979 Japan ..... 418/75
58-217788 12/1983 Japan ..... 418/102

*Primary Examiner*—John J. Vrablik

*Attorney, Agent, or Firm*—Browdy and Neimark

[57] ABSTRACT

An internal gear pump includes a casing, a cover mounted to the casing, a pump chamber defined between the casing and the cover, an internal gear slidably arranged within the pump chamber, an external gear rotatably arranged within the pump chamber and rotatingly driven from the outside to engage with and drive the internal gear, a fixed filler for regulating sliding movements of the internal and external gears and for preventing oil leakage from a high-pressure side to a lower-pressure side within the pump chamber, a suction port formed in the cover and extended circumferentially within the angular range of about 90 degrees, an oil pocket device formed in respective sliding surfaces of the casing and cover, on which the opposite side surfaces of the internal gear slide, the oil pocket device having a plurality of taper lands extended within the radial width of from the root of tooth of the internal gear to the outer peripheral surface of the internal gear between the peripheral wall of the pump chamber and the fixed filler, the bottom surface of each of the taper lands being tapered to become gradually shallow in the rotating direction of the internal gear, thereby producing a wedge film pressure between the opposite side surfaces of the internal gear and the respective sliding surfaces of the casing and the cover.

4 Claims, 9 Drawing Sheets

INTERNAL GEAR PUMP WITH TAPERED OIL POCKETS IN SLIDING SURFACES

CROSS REFERENCE TO RELATED APPLICATION

This is a continuation in part of patent application Ser. No. 233,544 filed on Aug. 18, 1988.

BACKGROUND OF THE INVENTION

The present invention relates to an internal gear pump and, more particularly, to a small-sized internal gear pump. A conventional internal gear pump of a first type comprises a casing, a cover mounted to the casing, a pump chamber defined between the casing and the cover when assembled with each other, an internal gear slidably arranged within the pump chamber, an external gear rotatably arranged within the pump chamber in meshing relation with the internal gear and rotatingly driven from the outside to drive the internal gear for carrying out a pumping action, a fixed filler for regulating sliding movements of the internal and external gears and for preventing oil leakage from a high-pressure side to a lower-pressure side within the pump chamber, first flat-bottomed oil pockets formed in the casing, one of which is provided in a sliding surface of the casing to face a suction port formed in the cover and is extended over about one-fourth the circumference of a circle on the casing, and the other of which is provided in the sliding surface of the casing to communicate with a discharge port of the casing and is extended over about one-fourth the circumference of a circle on the casing, and another first flat-bottomed oil pocket provided in the cover to face the first oil pocket of the casing communicated to the discharge port and extended over about one-fourth the circumference of a circle on the cover.

A conventional internal gear pump of a second type disclosed in Japanese Patent Unexamined Publication No 55-152209 is different from the above internal gear pump of the first type in that although there are provided third flat-bottomed oil pockets in those surfaces of a casing and a cover, on which an external gear slides, said oil pockets being extended over about one-fourth the circumference of a circle on the casing and on the cover, there are not any second oil pockets at those portions of the casing and the cover which face the opposite sides of the internal gear adapted to slide between the outer peripheral wall of a fixed filler and the inner peripheral wall of the casing. As described above, the oil pockets in the first and second types of the internal gear pump are flat-bottomed in configuration. In the prior internal gear pump described above, the sliding surfaces of the casing and the cover, on which the both gears slide, have a high level of sliding resistance, so that the internal gear pump is reduced in the total efficiency and also in the volumetric efficiency and become high in temperature at the sliding surfaces of the casing and the cover.

SUMMARY OF THE INVENTION

It is an object of the invention to solve the above problems of the prior internal gear pumps.

To attain the above object, the invention provides an internal gear pump comprising a casing; a cover mounted to the casing; a pump chamber defined between the casing and the cover; an internal gear slidably arranged within the pump chamber; an external gear rotatably arranged within the pump chamber and rotatingly driven from the outside to engage with and drive the internal gear; a fixed filler for regulating sliding movements of the internal and external gears and for preventing oil leakage from a high-pressure side to a lower-pressure side within the pump chamber; a suction port formed in the cover and extended circumferentially within the angular range of about 90 degrees; first oil pocket means including an oil pocket formed in the casing to face and extend coextensive with the suction port in the cover, an oil pocket formed in the casing to be communicated with a discharge port in the casing, and an oil pocket formed in the cover to face the oil pocket communicated with the discharge port in the casing, said each oil pocket being flat-bottomed to have a constant depth and extended circumferntially within the angular range of about 90 degrees; and second oil pocket means formed in respective sliding surfaces of the casing and cover, on which the opposite side surfaces of the internal gear slide, said second oil pocket means comprising a plurality of taper lands extended within the radial width of from the root of tooth of the internal gear to the outer peripheral surface thereof between the peripheral wall of the pump chamber and the fixed filler, the bottom surface of said each taper land being tapered to become gradually shallow in the direction of rotation of the internal gear, thereby producing a wedge film pressure between the opposite side surfaces of the internal gear and the respective sliding surfaces of the casing and cover.

DESCRIPTION OF THE PREFERRED EMBODIMENTS

Figure 8:
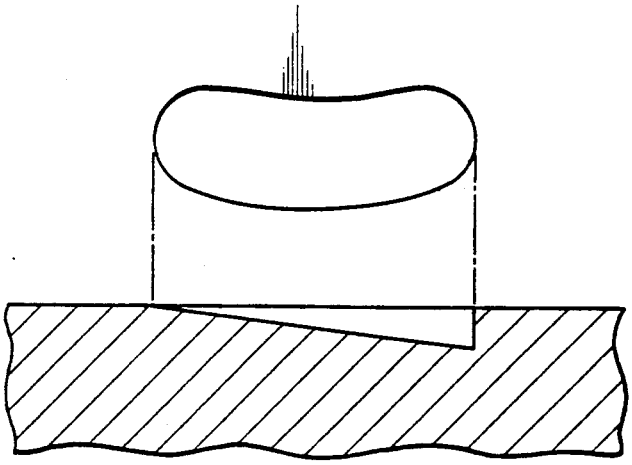
FIG. 8 is a view showing a top surface and vertical section of each taper land.
Figure 9:
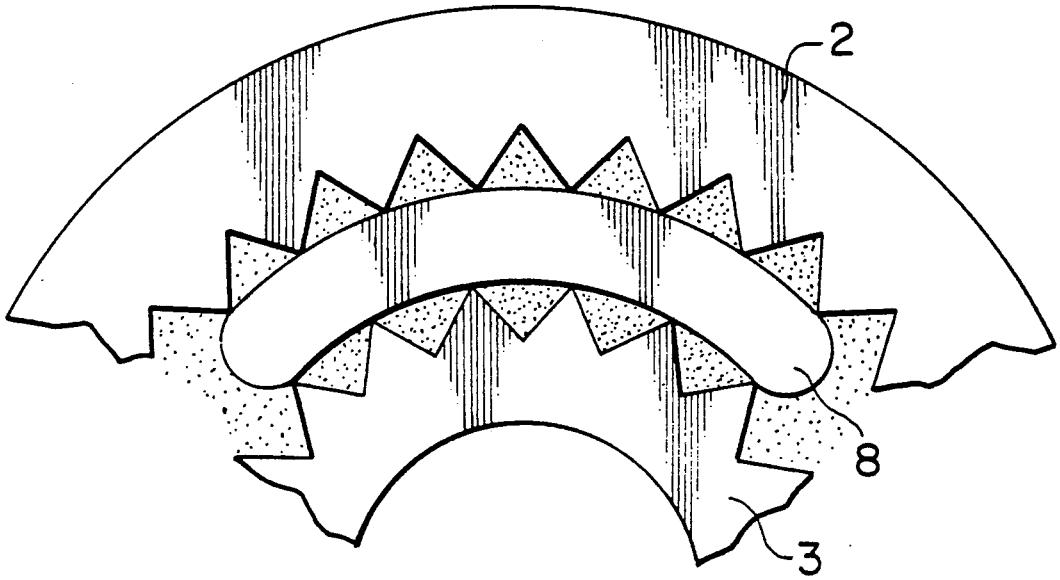
FIG. 9 is a fragmentary view showing the structural relationship among an internal gear, a fixed filler and an external gear illustrated in FIG. 1.

Referring to FIGS. 1 through 5, there is shown an internal gear pump 10 according to a first embodiment of the invention, in an exploded manner. The internal gear pump 10 includes a casing 1 of a columnar shape having a diameter of, for example, 50 mm, an internal gear 2, an external gear 3 fixedly mounted on a drive shaft 6, and a cover 4 of a columnar shape having a diameter of, for example, 50 mm. The casing 1 has a joining face 1*a* which mates with the cover 4. A lock pin 12 is fixedly mounted to the joining face 1*a*. The joining face 1*a* is formed therein with a recess 7, a discharge port 9, a lock bore 13, a pair of threaded blind bores 14 and a pair of through bores 15. The recess 7 of a cylindrical shape has a side wall surface 7*a* and a bottom face 7*b*, and cooperates with a joining face 4*a* of the cover 4 to define a pump chamber therebetween. The internal gear 2 and the external gear 3 are accommodated in the pump chamber, with the gears 2 and 3 in mesh with each other subsequently to be described. The recess 7 in the casing 1 is formed, in the bottom face 7*b*, with a plurality of first arcuate oil pockets 5*a* and 5*b*, and a plurality of second oil pockets or taper lands 5*c*, 5*d* and 5*e* such as shown in FIG. 8. A fixed filler 8 is formed on the bottom face the bottom face 7*b* of the recess 7 to extend through the entire casing 1.

Figure 1:
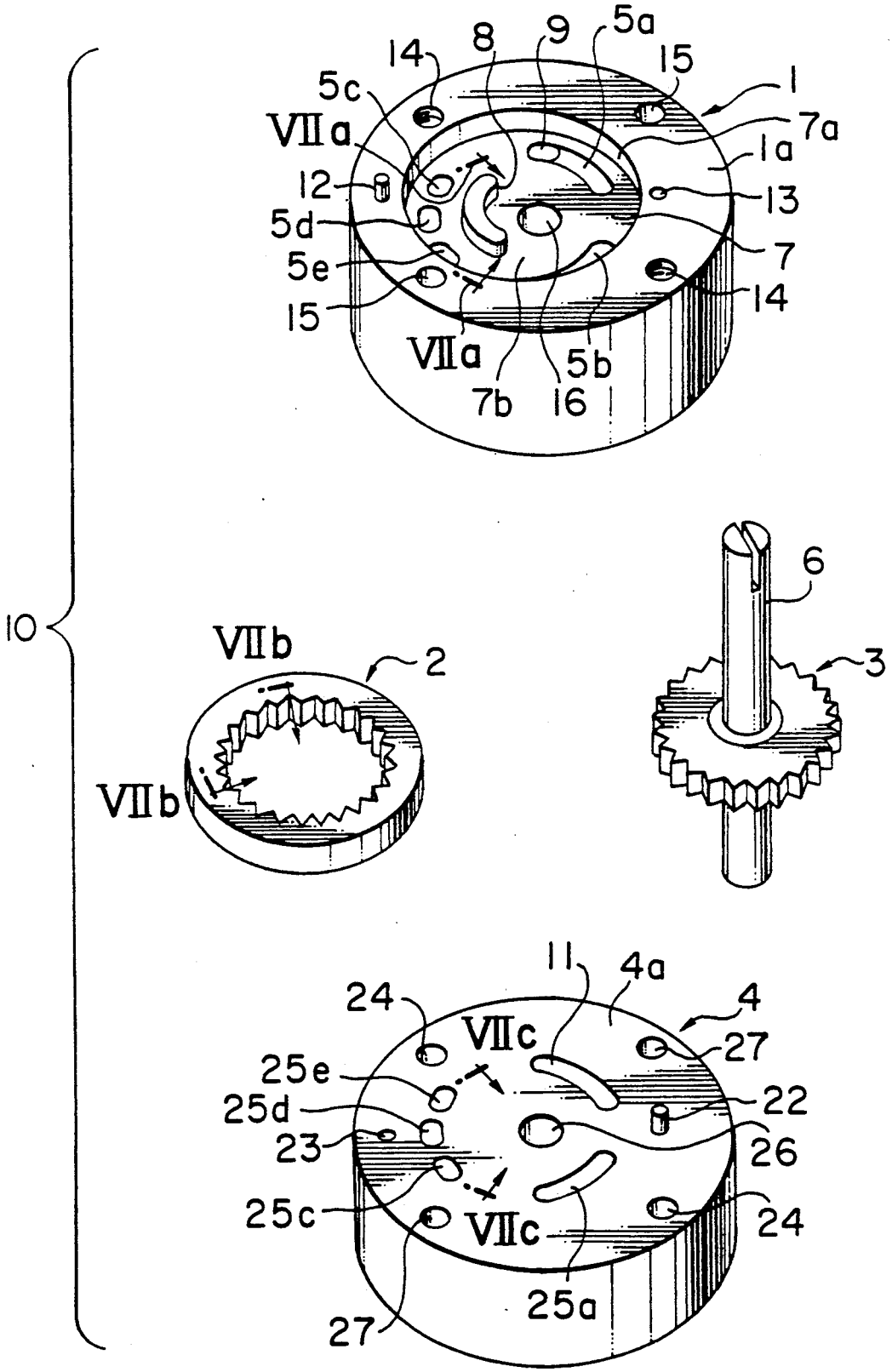
FIG. 1 is an exploded perspective view of an internal gear according to a first embodiment of the invention.
Figure 2:
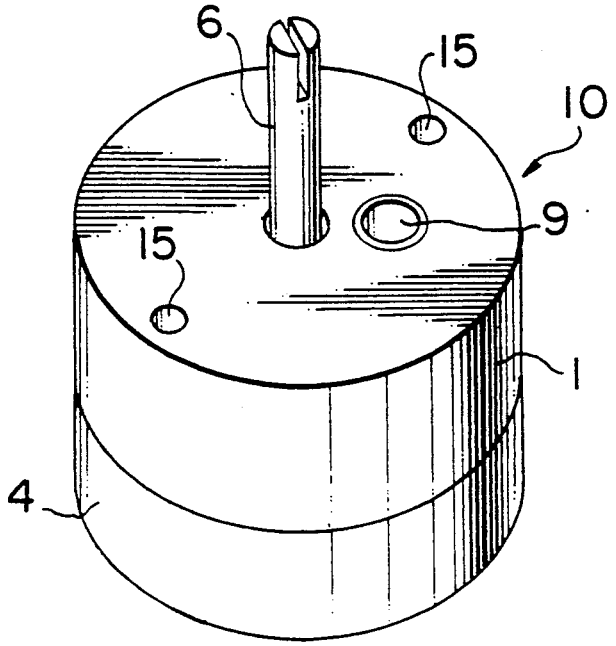
FIG. 2 is a perspective view of the internal gear pump shown in FIG. 1 when assembled.
Figure 3:
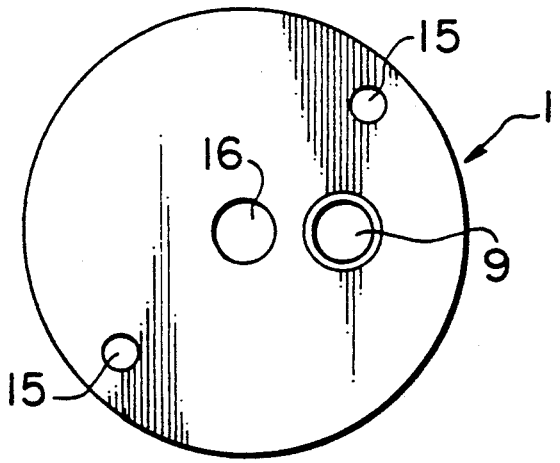
FIG. 3 is a top plan view of a casing shown in FIG. 1.
Figure 4:
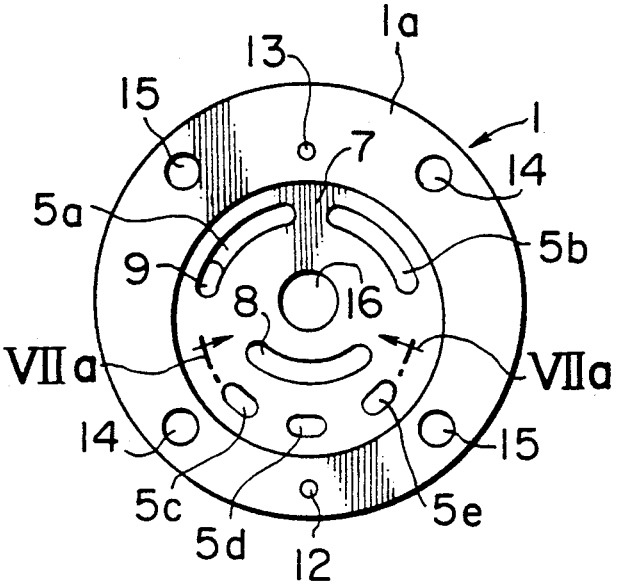
FIG. 4 is a view showing a joining face of the casing illustrated in FIG. 1.
Figure 5:
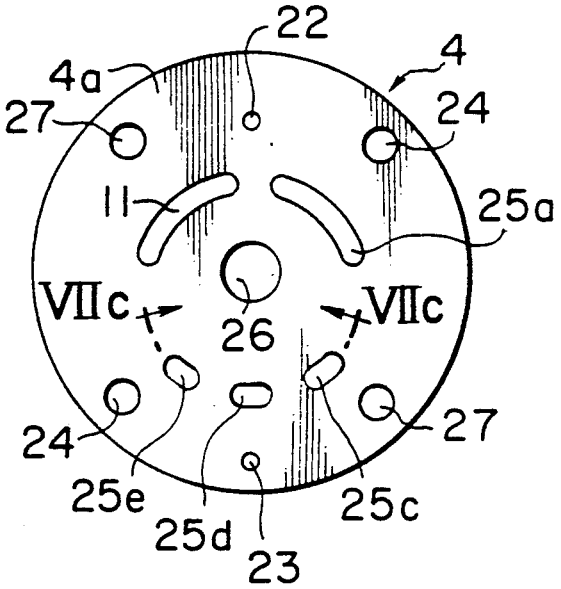
FIG. 5 is a view showing a joining face of a cover illustrated in FIG. 1.
Figure 6:
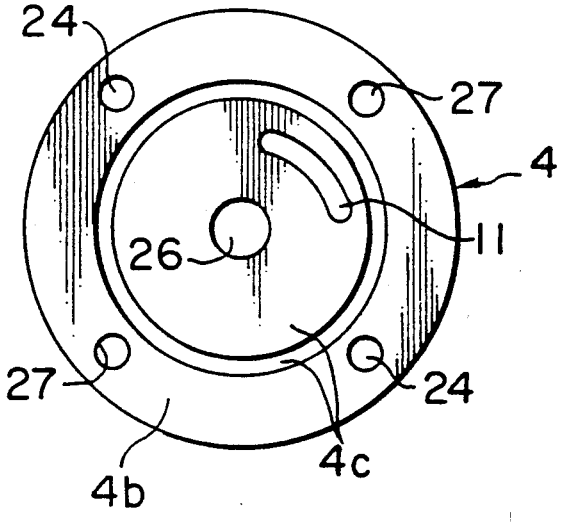
FIG. 6 is a bottom view of the cover shown in FIG. 1.

As shown in FIGS. 1, 5 and 6, a lock pin 22 is fixedly mounted to the joining face 4*a* of the cover 4. The joining face 4*a* is formed therein with a shaft bore 26, a first arcuate oil pocket 25*a*, second oil pockets or taper lands 25*c*, 25*d* and 25*e*, an arcuate suction port 11, a lock bore 23, a pair of mounting bores 24 and a pair of assembling bores 27. Screws are passed respectively through the mounting bores 24 to be screwed respectively into the threaded blind bores 14 in the casing 1, thereby assembling the casing 1 and the cover 4 together and making the two integral with each other. Screws are passed respectively through the assembling bores 27 and through the through bores 15 in the casing 1 such that the assembled casing 1 and cover 4 can be mounted to a suitable mechanical structure. The arcuate suction port 11 extends through the cover 4 and opens to a recess 4*c* formed in an outer bottom face 4*b* of the cover 4 on the side opposite to the joining face 4*a*, as shown in FIG. 6. Provided in this recess 4*c* is a filter of resin for removal of duct and the like contained in the liquid.

The first oil pockets 5*a*, 5*b* in the casing 1 and the first oil pocket 25*a* in the cover 4 are formed to have predetermined depths. The first flat-bottomed oil pocket 5*a* which is arcuate to have a depth of 4 mm and communicates with the discharge port 9 has a circumferential length of about one fourth the circumference of a circle and a radial width considerably greater than that of the internal gear 2 (as measured from the root of teeth to the outer peripheral surface thereof). Thus, the oil pocket 5*a* functions as a discharge chamber for facilitating discharge of the pressure oil through the discharge port 9. The first flat-bottomed oil pocket 25*a* which is formed in the cover 4 to have a depth of 4 mm and which is arcuate is located, when the pump has been assembled, at a position opposing the first oil pocket 5*a* of the casing 1. The pocket 25*a* has substantially the same shape and size as those of the first oil pocket 5*a*, and serves as a discharge chamber in which a high-pressure oil is accommodated. The arcuate suction port 11 has a circumferential length of approximately one fourth the circumference of a circle and a radial width considerably greater than that of the internal gear 2 (as measured from the root of teeth to the outer peripheral surface thereof). Thus, the suction port 11 serves as a suction chamber for drawing therein a large amount of liquid such as oil. The suction port 11 is not directly related to the formation of a liquid film in terms of the construction, but is related only to the suction pressure. The second oil pockets or taper lands 5*c*, 5*d* and 5*e* in the casing 1 and the second oil pockets or taper lands 25*c*, 25*d* and 25*e* in the cover 4 are formed in the bottom surface 7*b* of the recess 7 in the casing and in the joining surface 4*a* of the cover 4, respectively, to be located between an outer peripheral surface of the fixed filler 8 and an inner side wall surface 7*a* of the pump chamber, the bottom surface 7*b* and the joining surface 4*a* being those sliding surfaces on which the internal gear 2 slides. The width of each of the above-mentioned taper lands is sized to be within the range of from the root of teeth to the outer peripheral surface of the internal gear 2. Each of the above-mentioned taper lands has the maximum depth of 0.07 mm, and is tapered by a cutting tool of for example, 3.5 mm of diameter so as to become shallower in the rotating direction of the internal gear 2.

Figure 7A:
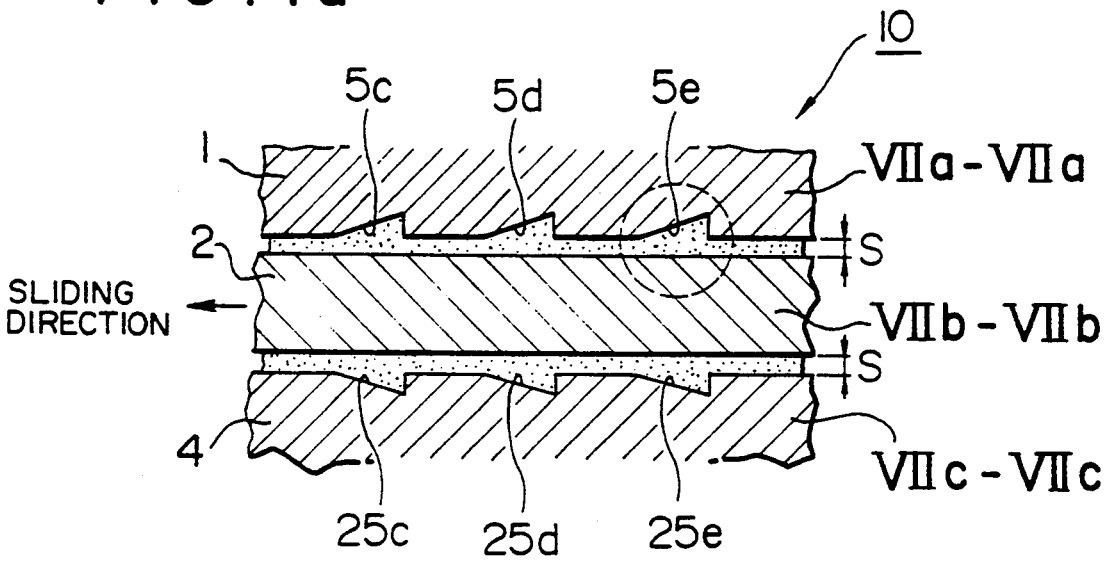
FIG. 7*a* is a vertically sectional view taken along the lines VIIa—VIIa, VIIb—VIIb and VIIc—VIIc of FIG. 1, showing the assembled state of the internal gear pump.

In assembling of the casing 1 and the cover 4, the internal gear 2 and the external gear 3 are accommodated in the pump in driving engagement, and one end of the drive shaft 6 is inserted into the shaft bore 26 in the cover 4 while the other end of the drive shaft 6 is passed through the shaft bore 16 in the casing 1 to be rotatively driven by any suitable drive means on the outside. The internal gear 2 is adapted to slide while being guided between the fixed filler 8 and the side wall surface 7*a* of the recess 7. This sliding movement of the internal gear 2 can be regulated by the fixed filler 8. The lock pin 12 on the casing 1 is fitted into the lock bore 23 in the cove 4 while the lock pin 22 on the cover 4 is fitted into the lock bore 13 in the casing 1. Referring to FIG. 7*a*, there are shown a vertical section of the casing 1 taken along the line VIIa—VIIa in FIG. 1, a vertical section of the internal gear 2 taken along the line VIIb—VIIb in FIG. 1, and a vertical section of the cover 4 taken along the line VIIc—VIIc in FIG. 1, when assembled.

In operation, as the external gear 3 is rotatively driven by the outside drive, the internal gear 2 rotatively slides in a direction indicated by an arrow in FIG. 7*a*, whereby liquid is drawn into the pump chamber through the suction port 11 in the cover 4. The liquid thus drawn is further sucked into the tooth spaces of the external gear 3 which slides along the radially inward peripheral surface of the fixed filler 8 while the liquid is simultaneously sucked into the tooth spaces of the internal gear 2 which slides along the radially outward peripheral surface of the fixed filler 8. The liquid is carried into the discharge chamber along the radially inward and outward peripheral surfaces of the fixed filler 8 and is forced out by meshing engagement between both the gears 2 and 3. More specifically, as the both gears are caused to rotate, the liquid is confined into the tooth spaces of the gears and gradually compressed to be discharged through the discharge port 9 under a high pressure.

Figure 7B:
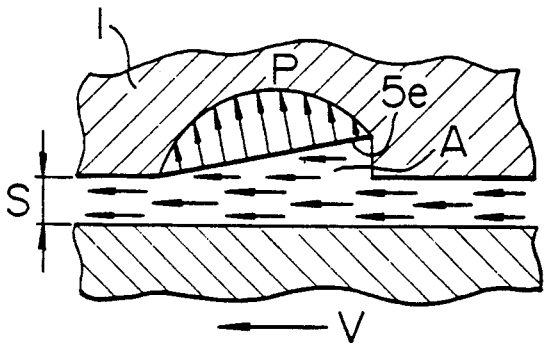
FIG. 7*b* is a view, partly enlarged, of FIG. 7*a;*

As the drive shaft 6 is driven for rotation, the liquid is drawn through the suction port 11 into the interspaces between the bottom surface 7*b* of the recess 7 in the casing 1 and the respective side surfaces of the gears 2, 3 and between the joining face 4*a* of the cover 4 and the respective side surfaces of the gears 2, 3. As the internal gear 2 rotates, the liquid contained in the respective deep portions A of the taper lands 5*e* and 25*e* in the casing 1 and cover 4 is compressed by the inclined surfaces of the taper lands as shown in FIGS. 7*a* and 7*b*. Therefore, the pressure P of the liquid, i.e., wedge film pressure, is raised. The smaller the interspace S between the bottom surface 7*b* of the recess in the casing 1 and the corresponding side surface of the internal gear 2 and the interspace S' between the joining face 4*a* of the cover 4 and the corresponding side surface of the internal gear 2, the higher the liquid pressure P. As the internal gear 2 is further rotated, the wedge film pressure P is similarly produced in the remaining taper lands 5*d*, 5*c* in the casing 1 as well as the remaining taper lands 25*d*, 25*e* in the cover 4. This causes the internal gear 2 to be floated between the casing 1 and the cover 4, thereby preventing seizure, drag and temperature rise.

In this manner, the wedge film pressure P generated between the opposite side surfaces of the internal gear 2 and their corresponding respective sliding surfaces of the casing 1 and cover 4 acts like a lubricating oil film pressure in a sliding bearing, thus floating the internal gear 2.

Figure 10:
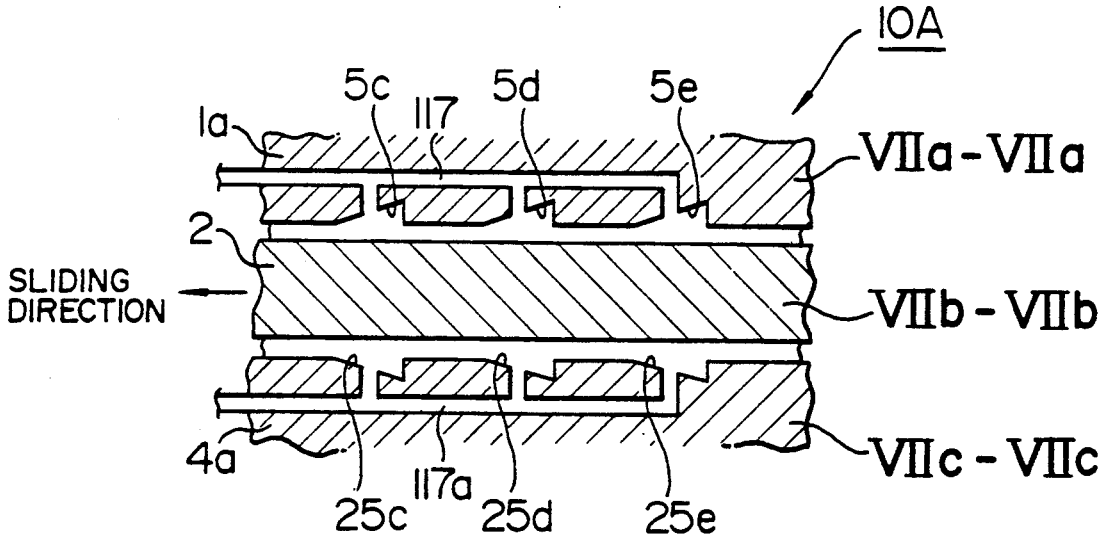
FIG. 10 is a vertically sectional view, similar to FIG. 7*a*, showing an internal gear pump according to a second embodiment of the invention.

Referring to FIG. 10, an internal gear pump 10A according to a second embodiment of the invention is partly shown in its assembled state. In this second embodiment, the casing 1*a* is formed therein with communicating passages 117 for making communication between the first oil pocket 5*a* communicated with the discharge port 9 and the taper lands 5*c*, 5*d* and 5*e*. The cover 4*a* is formed therein with communicating passages 17*a* for making communication between the first oil pocket 25*a* and the taper lands 25*c*, 25*d* and 25*e*. Thus, the high pressure oil in the discharge chamber can be compulsively supplied into the taper lands and, at the same time, the wedge oil film layers are formed. This prevents both the gears from coming near the sliding surface of the casing 1 or cover 4, so that the generation of noises as well as the occurrence of any wear, seizure, and drag is eliminated.

Figure 11A:
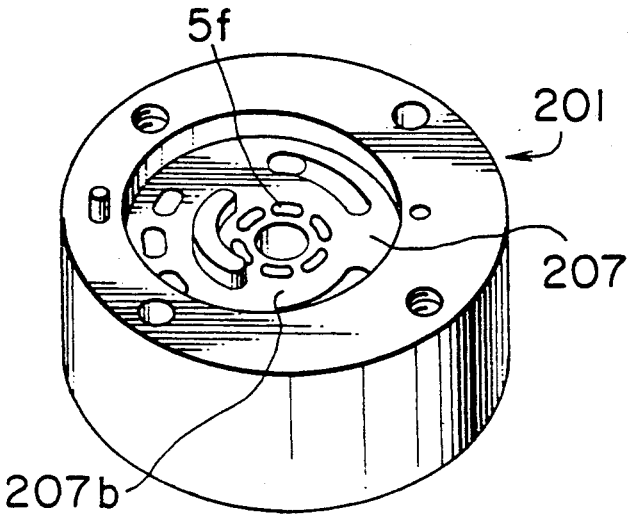
FIGS. 11*a* and 11*b* are perspective views respectively showing a casing and a cover of an internal gear pump according to a third embodiment of the invention.
Figure 11B:
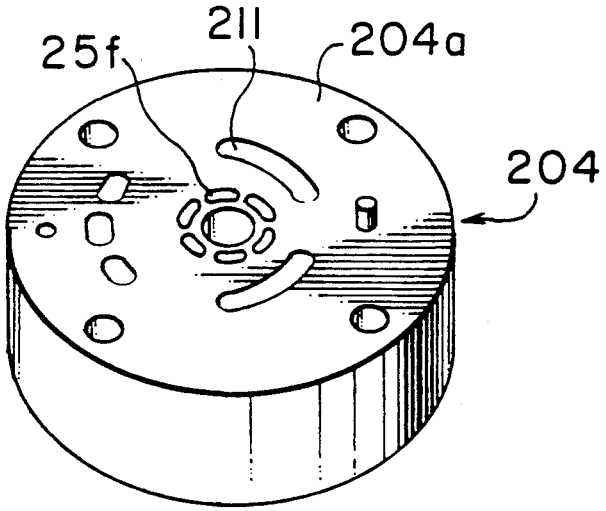
Figure 11C:
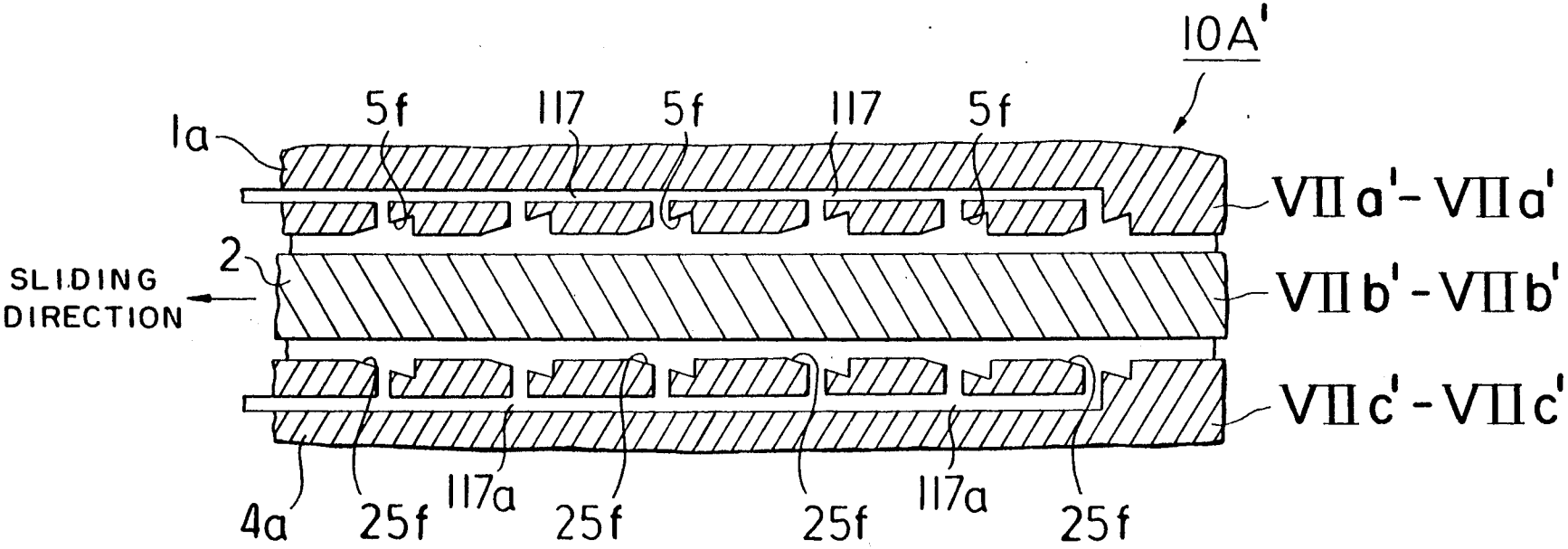
FIG. 11*c* is a vertical sections showing an internal gear pump according to a third embodiment of the invention.

Referring now to FIGS. 11*a* and 11*b* , there are shown a casing 201 and a cover 204 of an internal gear pump according to a third embodiment of the invention. The casing 201 is formed in a bottom surface 207*b* of its recess 207 with third oil pockets, i.e., taper lands 5*f* while the cover 204 is formed in its joining face 204*a* with third oil pockets, i.e., taper lands 25*f*. The taper lands 5*f* and 25*f* have a shape similar to that of the taper lands 5*c*, 5*d*, 5*e*, 25*c*, 25*d* and 25*e* in the first embodiment, and are located within the range of from the root of teeth of the external gear 3 to a peripheral surface of the shaft bore 16 or 26 as viewed when the pump has been assembled. Thus, a wedge film pressure is generated in the interspaces between opposite side surfaces of the external gear 3 and their corresponding, or opposing, respective sliding surfaces of the casing and cover. This prevents the generation of wear, seizure, and/or drag in the external gear or the sliding surfaces of the casing and cover.

The internal gear pump of the third embodiment may be further formed therein with such communicating passages as in the second embodiment between the first oil pocket 5*a* and the taper lands 5*c*, 5*d*, 5*e* and 5*f* in the casing 201 and between the first oil pocket 25*a* and the taper lands 25*c*, 25*d*, 25*e* and 25*f* in the cover 204. Since, in this case, the pressure oil is compulsively supplied to each of the taper lands in addition to the generation of the wedge film pressure from each of the taper lands themselves, the effect of preventing the generation of noises as well as wear, seizure, and/or drag is further improved.

Figure 12:
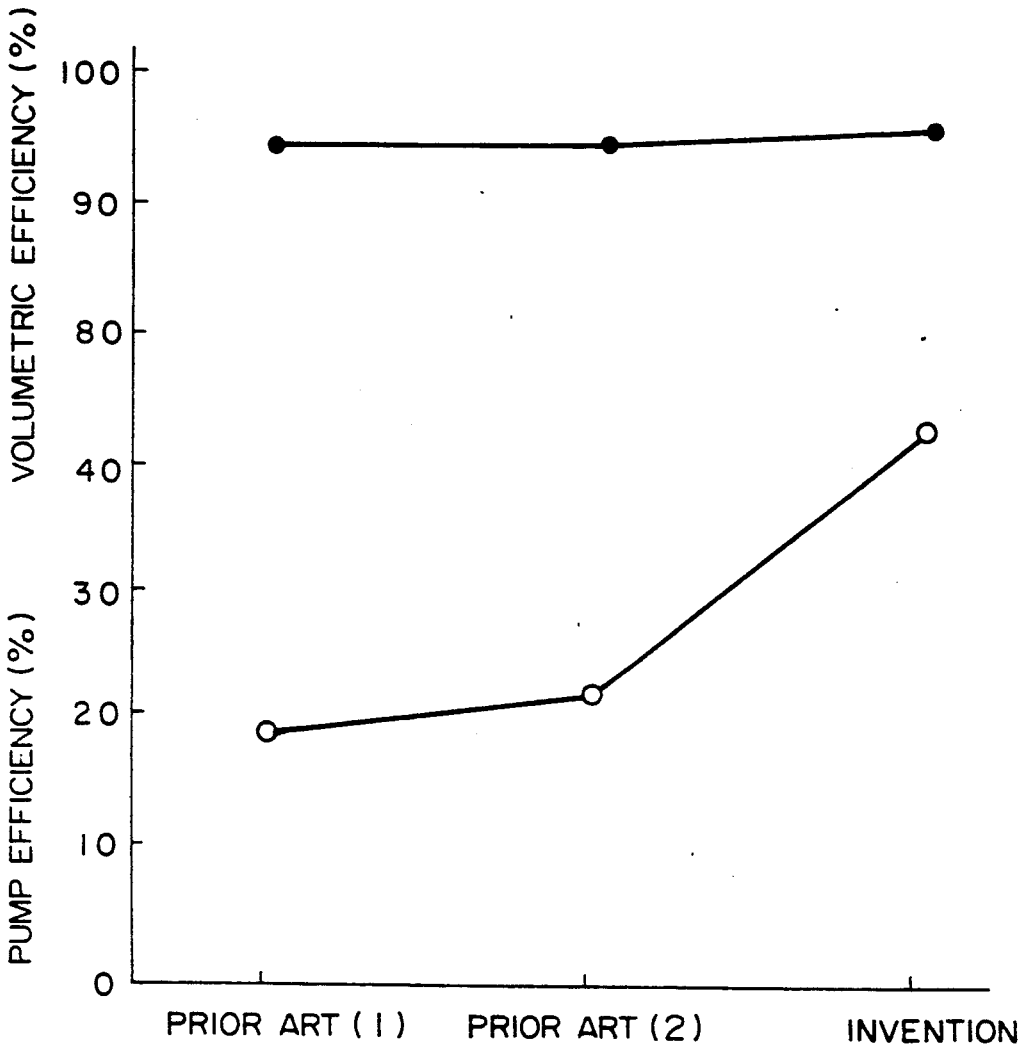
FIG. 12 is a graphical representation of the comparison in performance between an internal gear pump of a conventional construction and the internal gear pump according to the invention.
Figure 12:
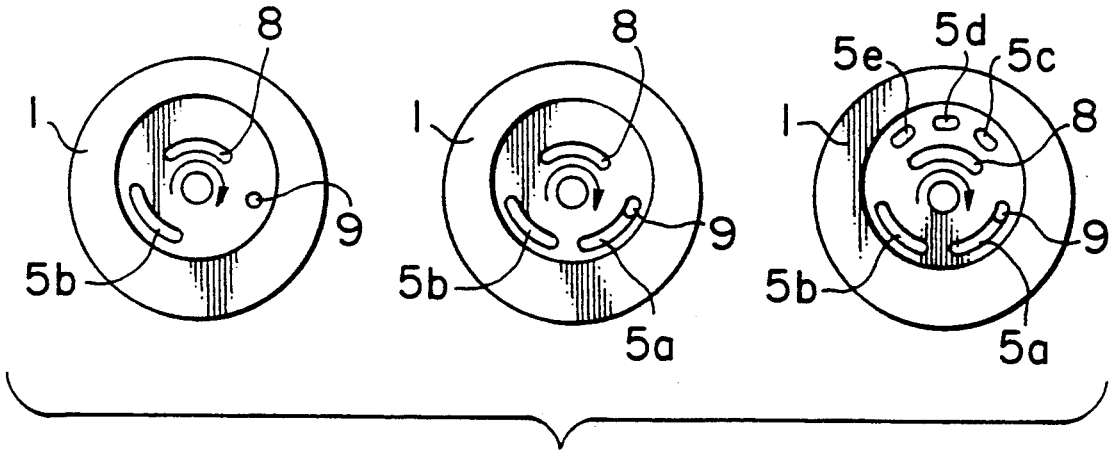
Figure 13:
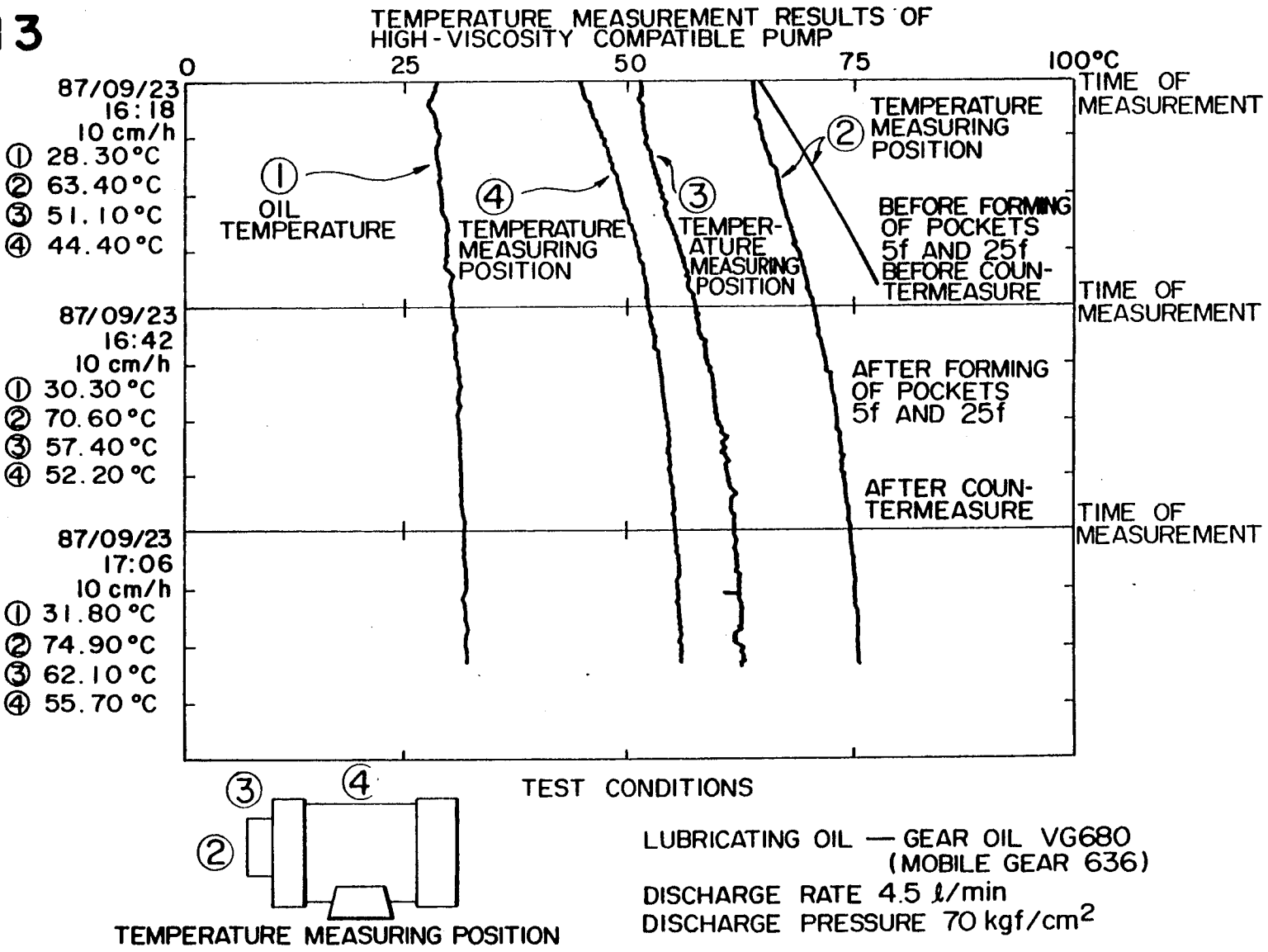
FIG. 13 is a graphical representation showing the performance of the internal gear pump according to the invention and the performance of the internal gear pump of the prior art.

Referring to FIG. 12, there is shown a graph which compares the performance of the internal gear pump according to the invention with that of the internal gear pump of the conventional construction. Shown below the graph are configurations of the bottom faces of the pump chambers in the respective pumps used in the experiment. The experimental conditions were that the discharge pressure was 25 $Kg/cm^2$, the rotational speed N was equal to 1 r.p.m., and the outer diameter of the gear was 30 mm. The graph clearly shows that the internal gear pump according to the invention is improved twice in pump efficiency and is slightly improved in volumetric efficiency, as compared with the internal gear pump of the conventional construction Referring to FIG. 13, there is shown a graph which reveals the temperature measurement results of the internal gear pump in case the third oil pockets or taper lands 5*f* and 25*f* are provided and in case no such third oil pockets or taper lands are provided. In this Figure, the abscissa represents temperature and the ordinate time of measurement. Symbol ① represents oil temperature, ② represents temperatures in the vicinity of the internal gear and external gear, ③ represents temperature at the bearing portion of a motor involved, and ④ represents temperature of a body of the motor.

The internal gear pump according to the invention has the following advantages:

(a) Provision of the second oil pockets in the casing and the cover enables the pump efficiency to be improved considerably, and also enables the volmetric efficiency to be improved slightly. These efficiencies are further improved by provision of the third oil pockets in the casing and/or the cover.

(b) The construction provided with the oil pockets into which the oil is introduced from the suction side, enables oil adequate in pressure to be obtained so that oil films are formed on the sliding reduce the sliding resistance of the internal gear and the external gear and to increase wear resistance thereof.

What is claimed is:

1. In an internal gear pump having a casing; a cover mounted to the casing; a pump chamber defined between the casing and the cover; an internal gear slidably arranged within the pump chamber; an external gear rotatably arranged within the pump chamber and rotatingly driven from the outside to engage with and drive the internal gear; a fixed filler for regulating sliding movements of the internal and external gears and for preventing oil leakage from a high-pressure side to a lower-pressure side within the pump chamber; a suction port formed in the cover and extended circumferentially within the angular range of about 90 degrees; first oil pocket means including an oil pocket formed in the casing to face and extend coextensive with the suction port in the cover, an oil pocket formed in the casing to be communicated with a discharge port in the casing, and an oil pocket formed in the cover to face the oil pocket communicated with the discharge port in the casing, said each oil pocket being flat-bottomed to have a constant depth and extended circumferentially within the angular range of about 90 degrees, the improvement comprising second oil pocket means formed in respective sliding surfaces of the casing and cover, on which the opposite side surfaces of the internal gear slide, said second oil pocket means comprising a plurality of taper lands extended only within the radial width of from the root of tooth of the internal gear to the outer peripheral surface thereof and between the peripheral wall of the pump chamber and the fixed filler, the bottom surface of said each taper land being tapered to become gradually shallow in the direction of rotation of the internal gear, thereby producing a wedge film pressure between the opposite side surfaces of the internal gear and the respective sliding surfaces of the casing and cover.

2. An internal gear pump as set forth in claim 1, wherein aid casing is formed therein with communicating passages for making communication between said oil pocket communicated with said discharge port in said casing and said respective taper lands of said second oil pocket means in said casing, and said cover is formed therein with communicating passages for making communication between said oil pocket in said cover to face the oil pocket communicated with the discharge port in the casing and said respective taper lands of said second oil pocket means in said cover.

3. An internal gear pump as set forth in claim 1 further comprising third oil pocket means formed in those respective sliding surfaces of said casing and said cover, on which the opposite side surfaces of said external gear slide, said third oil pocket means comprising a plurality of taper lands extending radially inwardly from the root of teeth of said external gear and circumferentially spaced from one another, said each taper land being tapered at the bottom surface thereof such that the bottom surface becomes gradually shallow in the rotating direction of said external gear, whereby wedge film pressures are produced between the opposite side surfaces of said external gear and the respective sliding surfaces of said casing and said cover.

4. An internal gear pump as set forth in claim 3, wherein said casing is formed therein with communicating passages for making communication between said oil pocket communicated with said discharge port in said casing and said respective taper lands of said third oil pocket means in said casing, and said cover is formed therein with communicating passages for making communication between said oil pocket in said cover o face the oil pocket communicated with the discharge port in the casing and said respective taper lands of said third oil pocket means in said cover.

* * * * *